US010290167B2

(12) United States Patent
Souparis et al.

(10) Patent No.: US 10,290,167 B2
(45) Date of Patent: May 14, 2019

(54) METHOD FOR MAKING AN OBJECT SECURE, AND CORRESPONDING OBJECT

(75) Inventors: Hugues Souparis, Nogent sur Marne (FR); Kristen Le Liboux, Paris (FR)

(73) Assignee: HOLOGRAM INDUSTRIES, Bussy Saint Georges (FR)

( * ) Notice: Subject to any disclaimer, the term of this patent is extended or adjusted under 35 U.S.C. 154(b) by 392 days.

(21) Appl. No.: 13/522,796

(22) PCT Filed: Dec. 20, 2010

(86) PCT No.: PCT/FR2010/052822

§ 371 (c)(1),
(2), (4) Date: Sep. 18, 2012

(87) PCT Pub. No.: WO2011/086275

PCT Pub. Date: Jul. 21, 2011

(65) Prior Publication Data

US 2013/0002713 A1 Jan. 3, 2013

(30) Foreign Application Priority Data

Jan. 18, 2010 (FR) ..... 10 00176

(51) Int. Cl.

| | |
|---|---|
| ***G07D 7/2033*** | (2016.01) |
| ***G07F 7/00*** | (2006.01) |
| ***G07F 7/12*** | (2006.01) |
| ***G07D 7/0047*** | (2016.01) |

(52) U.S. Cl.
CPC ..... *G07D 7/2033* (2013.01); *G07D 7/0047* (2017.05); *G07F 7/125* (2013.01)

(58) Field of Classification Search
CPC ..... G07D 7/0033; G07D 7/2033; G07F 7/125
USPC ..... 345/629; 382/100
See application file for complete search history.

(56) References Cited

U.S. PATENT DOCUMENTS

| | | | | |
|---|---|---|---|---|
| 5,841,886 | A * | 11/1998 | Rhoads | 382/115 |
| 6,244,508 | B1 * | 6/2001 | Straub | 235/449 |
| 7,632,380 | B2 * | 12/2009 | Doublet | 162/140 |
| 8,059,858 | B2 * | 11/2011 | Brundage et al. | 382/100 |
| 2003/0138128 | A1 * | 7/2003 | Rhoads | 382/100 |
| 2005/0195193 | A1 * | 9/2005 | Lehman | 345/440 |
| 2007/0164557 | A1 * | 7/2007 | Oakes | 283/74 |
| 2009/0033914 | A1 * | 2/2009 | Doublet | 356/71 |
| 2010/0172538 | A1 * | 7/2010 | Rhoads | 382/100 |
| 2011/0044556 | A1 * | 2/2011 | Swanson | G06K 15/107 382/275 |
| 2013/0241190 | A1 * | 9/2013 | Menz et al. | 283/75 |

FOREIGN PATENT DOCUMENTS

| | | | |
|---|---|---|---|
| FR | 2890666 | A1 | 3/2007 |
| WO | 2004089649 | A2 | 10/2004 |
| WO | 2005010814 | A1 | 2/2005 |
| WO | 2006053685 | A2 | 5/2006 |

* cited by examiner

*Primary Examiner* — Hai Tao Sun
(74) *Attorney, Agent, or Firm* — Bachman & LaPointe, P.C.

(57) ABSTRACT

A method for making an object secure comprises creating a multi-layer graphic signature by superposing, in partial or total transparency, a first random graphic element on a first layer to a second graphic element on a second layer, and storing the graphic signature on or in the object. The method is essentially characterized in that the relative position of the first graphic element and of the second graphic element is random.

5 Claims, 3 Drawing Sheets

METHOD FOR MAKING AN OBJECT SECURE, AND CORRESPONDING OBJECT

BACKGROUND

The present invention relates to the field of making objects secure, including optionally the verification and authentication of the latter.

SUMMARY OF THE INVENTION

More precisely, the invention relates, according to a first of its objects, to a method for making an object secure comprising steps consisting in:

creating a multi-layer graphic signature by superposing, in partial or total transparency, a first graphic element on a first layer and a second graphic element on a second layer, of which at least one graphic element comprises a random graphic element, and storing the said graphic signature on or in the object.

According to the invention, the method is essentially characterized in that:

the relative position of the first graphic element and of the second graphic element is random.

By virtue of this feature, the graphic signature is unique.

Preferably, the creation of the multi-layer graphic signature also comprises the superposition in partial or total transparency of a third graphic element on a third layer, distinct from the first and second layers, the relative position of the said third graphic element and of the said first graphic element and/or of the said second graphic element being random, the said third graphic element being able to comprise a random graphic element.

By virtue of this feature, the object bearing the graphic signature is extremely secure.

The multi-layer graphic signature according to the invention therefore comprises by superposition at least two graphic elements. Each graphic element comprises for example at least one of the following elements:

a set of lines or dots, a set of drawings, coats of arms, logos, a set of images in colour/grey levels, a set of holographic effects, a set of demetallization effects.

In one embodiment, the storage step comprises a step consisting in affixing the said multi-layer graphic signature on the said object, or in incorporating the said multi-layer graphic signature in the said object. This makes it possible to make the object secure: from the solid block of the latter during its fabrication, by affixing for example in the form of a label, or else by also using its packaging.

For example in one embodiment, the said object is a multi-layer object, the incorporation of the said multi-layer graphic signature in the said object being carried out in at least one of the layers of the said object.

In one embodiment, each layer of the signature is a respective layer of the said object.

Preferably, the method also comprises steps consisting in:

taking a first photograph of the multi-layer graphic signature, computing a first digital signature of the said photograph and saving the said digital signature in a database so as to constitute at least one portion of a reference digital signature, and saving in the said database a digital or alphanumeric identifier associated with the said first digital signature.

The digital or alphanumeric identifier may be dependent on or independent of the object or of the signature. The digital or alphanumeric identifier makes it possible to index the digital signature. Accordingly, it may be an index number, a sequential saving number, or it may correspond to at least one distinctive or nominative element of the object.

This allows the subsequent verification of the authenticity of the object.

Preferably, the taking of the first photograph of the multi-layer graphic signature is carried out during the fabrication of the object, for example by virtue of a CCD sensor so that the digital reference signature is created from the first photograph before the object is marketed.

Preferably, the method also comprises steps consisting in:

creating a graphic identifier, optionally a multi-layer identifier, from a photograph of the superposed assembly of the said first graphic element and second graphic element, and the said third graphic element when it exists; and/or from the said at least one distinctive or nominative element of the object, and storing the said graphic identifier on or in the object, optionally on one of the layers of the said multi-layer signature.

This makes it possible to make the object secure again and to make the processing of its verification easier. For example, the graphic identifier is a data matrix.

In one embodiment, the said graphic identifier is printed on one of the layers of the said multi-layer signature.

Preferably, the method also comprises steps consisting in:

producing a second digital photograph of the multi-layer graphic signature of the object, computing a second digital signature of the said photograph, comparing the first and the second digital signatures, and authenticating or not the graphic signature depending on the result of the comparison.

Preferably, the second digital photograph of the multi-layer graphic signature is taken after the fabrication of the object, so that the second digital signature is created after the object is marketed.

Preferably, the comparison of the first and of the second digital signatures comprises steps consisting in:

reading the graphic identifier, extracting therefrom the corresponding digital identifier, and selecting the associated reference digital signature.

This makes it possible to increase the processing speed, therefore to make it easier to verify the authenticity of the object.

Advantageously, the method also comprises a step of determining the type of signature/object.

The invention also relates to a computer program comprising program-code instructions for the execution of the steps of a method as defined above, when the said program is run on a computer.

According to another of its objects, the invention relates to a secured object comprising:

a multi-layer graphic signature made by superposition in partial or total transparency of a first random graphic element on a first layer and of a second graphic element on a second layer, stored on or in the said object, of which at least one graphic element preferably comprises a random graphic element.

According to the invention, the object is essentially characterized in that the relative position of the first graphic element and of the second graphic element is random.

Preferably, the object also comprises a third graphic element which may comprise a random graphic element, on a third layer distinct from the first layer and second layer, and in which the relative position of the said third graphic element and of the said first graphic element and/or of the said second graphic element is random.

In one embodiment, the object also comprises a graphic identifier optionally a multi-layer graphic identifier, from a photograph of the superposed assembly of the said first graphic element and second graphic element, and of the said third graphic element when it exists; and/or from the said at least one distinctive or nominative element of the object. The graphic identifier makes it possible to indicate unequivocally the secured object in a database by virtue of its corresponding digital identifier for the purpose of the authentication of the said object.

Advantageously, the said graphic identifier is printed on one of the layers of the said multi-layer signature, preferably in the form of a data matrix.

In one embodiment, the said object is a multi-layer object of which one of the layers supports or contains the first graphic element, another layer supports or contains the second graphic element, and optionally yet another layer, when it exists, supports or contains the third graphic element.

In one embodiment, the object and the graphic signature comprise the same number of layers so that each layer of the signature is a respective layer of the said object.

In one embodiment, the object also comprises a packaging of which the layer or one of the layers is the first layer, second layer, or third layer when it exists.

The invention ensures the uniqueness and the non-reproducibility of the signature, and hence the security of the object. Specifically, even though it is theoretically possible to regenerate on computer the same code (same graphic element(s)) and to reprint it on an object, because of the mechanical tolerances of the processes used, this/these graphic element(s) will never be situated in exactly the same place, which in practice makes the reproduction of the signature virtually impossible.

The invention also has the advantage that it is possible for the association of the signature with the object not to require the use of materials that are exogenous to the said object. Its longevity is therefore the same as an object with which such a signature is not associated.

BRIEF DESCRIPTION OF THE DRAWINGS

Other features and advantages of the present invention will appear more clearly on the reading of the following description given as an illustrative and non-limiting example and made with reference to the appended figures in which.

DETAILED DESCRIPTION OF THE PREFERRED EMBODIMENT(S)

For greater clarity of the present description, essentially the embodiment will be described in which the object 10 to be made secure is a multi-layer object, in this instance a document, an official identity document (card) for example, in which the multi-layer signature 23 according to the invention is incorporated.

Those skilled in the art will transpose this embodiment to other multi-layer objects with partial layers in which the multi-layer graphic signature according to the invention is produced on at least one of the partial layers; and/or else to objects comprising a packaging in which the packaging forms at least one of the layers.

"Partial layer" means a layer of which the surface is below the surface of the object on which the latter is superposed, for example a label.

Figure 1:
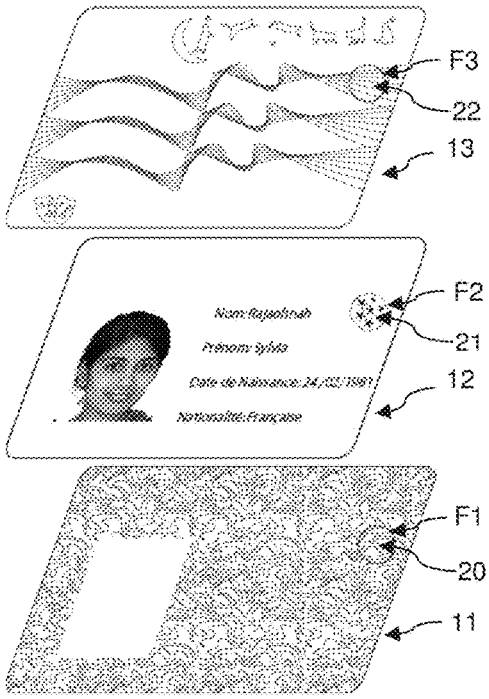
FIG. 1 illustrates an exploded view of one embodiment of an object of the identity card type according to the invention.

In the case of a document or of a multi-layer card, the object 10 typically comprises a first layer 11, called the base layer, on which a first graphic is printed, for example in the form of guilloche patterns (FIG. 1). For an identity card for example, the card consists of an assembly of several layers produced independently. The first layer is usually printed using offset-printing, screen-printing or other printing techniques used to produce security graphics. During fabrication, the independent layers are assembled in printing plates comprising for example 24 or 48 cards and each card is then individually cut.

On the first layer 11, a second layer 12, for example made of polycarbonate, for example able to be personalized by laser marking, is affixed, in which a second graphic, different from the first graphic, is printed. In the case of an identity card, the second graphic is printed during the personalization step of the card, once the card is assembled.

In one embodiment, on this second layer is affixed a third layer 13 optionally used for protection, on which a third graphic, in this instance an optically variable element, may be inscribed or printed. "Optically variable" means an element of which at least one of its aspects changes when it is subjected to a relative movement in relation to the line of sight of an observer (human being, camera).

The relative movement may be a translation and/or a rotation movement about a horizontal axis (the X axis), about a vertical axis (the Y axis), and/or a rotation in the plane of the secured object (the Z axis).

The changes of aspect may relate notably to all or some of the following elements:

change of colour depending on the orientation,
change of viewing angles of a 3D hologram
movement of an image element
change of aspect of the image
disappearance of one image and replacement by another
etc.

According to the invention, the graphic signature 23 is a multi-layer signature. Each graphic element 20, 21, 22 of the multi-layer graphic signature is included in a respective graphic window F1, F2, F3, the shapes and dimensions of the windows F1, F2, F3 preferably being identical to one another. Thus, the graphic signature within the meaning of the present invention is the graphic resulting from the superposition of the said windows, by partial or total transparency of one set of graphic elements distributed over a plurality of layers as illustrated in FIG. 2. The graphic windows correspond for example to all or some of one face of the object 10.

In order to simplify the present description, only the embodiment in which each layer comprises a respective unique graphic element will be described.

There is therefore at least one first element 20 of graphic signature on a first layer 11 and at least one second element 21 of graphic signature on a second layer 12.

The first element 20 of graphic signature may be a predetermined graphic element (image, logo or other element) or a random graphic element.

"Random graphic element" means, in a given graphic window, a graphic comprising an assembly of at least one graphic element, of which at least one of the following characteristics of each element is random:

the shape,
the pattern,
the colour(s), or the grey levels,
the position in the graphic window,
the size.

The population of unique elements generated by the algorithm used for the creation of the random graphic element is preferably greater than a million.

The object analysed for the verification/authentication of the signature is the overall pattern obtained by superposition of the layers.

The overall pattern is itself printed with a positional tolerance relative to the printing medium/media that the layers represent, of which at least one preferably comprises at least one fixed (non-random) element that can be analysed.

Thus, the combination of the random graphic element generated by the algorithm and the random positioning element of the graphic windows F1, F2, F3 (see below) provides a real random source in the overall pattern to be analysed, that is to say in the graphic signature 23.

The algorithm below is a basic example of random generation, in this instance pseudo-random generation.

Figure 3A:
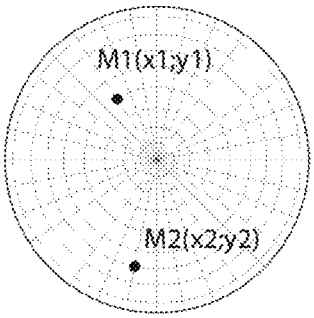
FIGS. 3A to 3H illustrate embodiments of random graphic elements according to the invention.
Figure 3B:
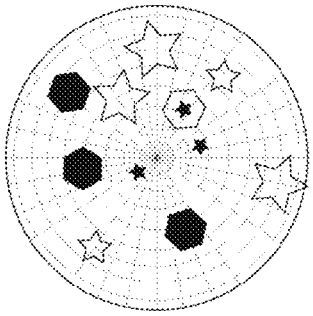
Figure 3C:
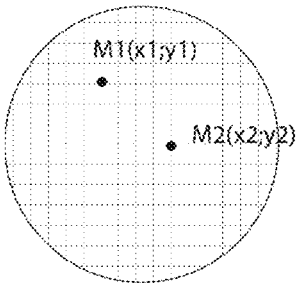
Figure 3D:
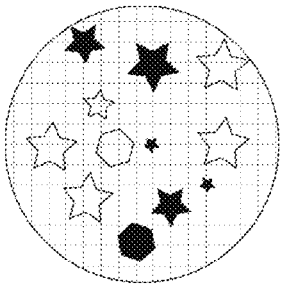
Figure 3E:
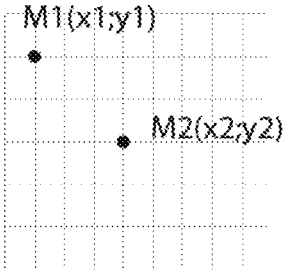
Figure 3F:
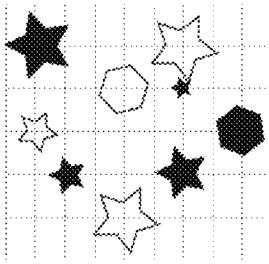
Figure 3G:
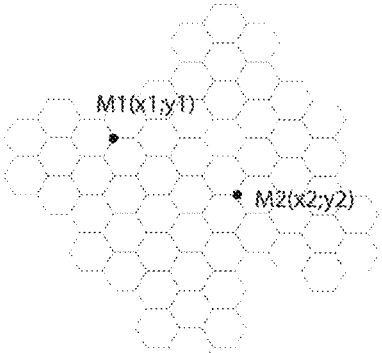
Figure 3H:
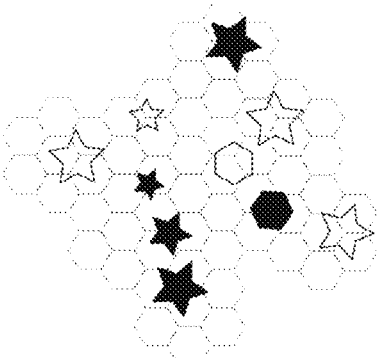
Figure 4:
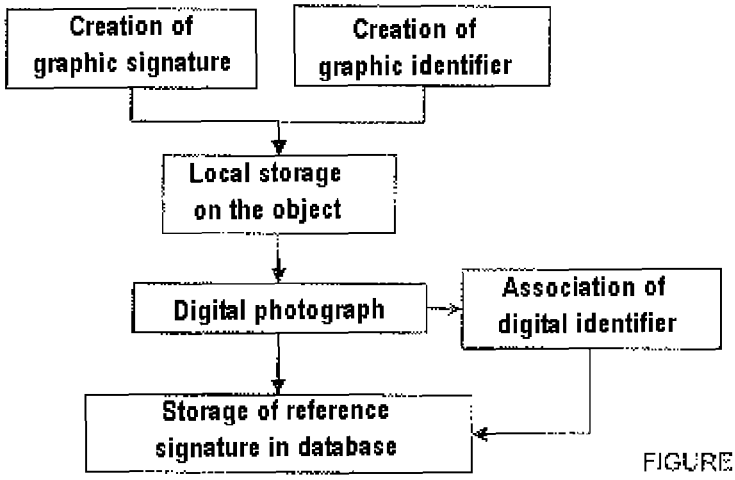
FIG. 4 illustrates one embodiment of the method according to the invention.
Figure 5:
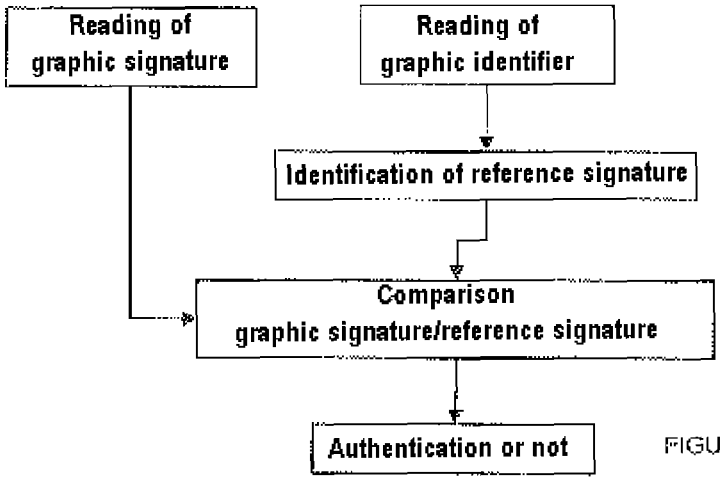
FIG. 5 illustrates one embodiment of a graphic signature according to the invention, for the purpose of the authentication of the object.

1. Creation of a radial matrix (FIG. 3A, 3B), a circular matrix (FIG. 3C, 3D), a square or rectangular matrix (FIG. 3E, 3F), a honeycomb matrix (FIG. 3G, 3H), or of any shape, meshed by a grid of predetermined shape: square, triangular, radial or other.
2. Determination of a random number N of patterns that the graphic signature comprises (for example generated by a RAND( ) function added to a domain typically going from 10 to 30). As a purely illustrative example, the patterns are polygons (FIGS. 3B, 3D, 3F, 3H).
3. Determination of the locations of the N patterns on the grid defined by the chosen matrix; the coordinate of each pattern $M_i$ is given by the formula:

$$(XM_i;\ YM_i)=(\mathrm{RAND}(1;\ X_{max});\ \mathrm{RAND}(1;\ Y_{max}))$$

where $X_{max}$ is the horizontal size of the discrete table. $Y_{max}$ is the vertical size.

For each pattern $M_i$ it is possible to determine a random size between predefined limits ($t_{min}<t_i<t_{max}$) and an orientation $\alpha$ over the range [0, 360° ] or over a more restricted range ($\alpha_{min}<\alpha_i<\alpha_{max}$).

Each random pattern $M_i$ is therefore characterized notably by its x coordinate ($M_i$(xi)), its y coordinate ($M_i$(yi)) on the grid, its size and its orientation.

Another parameter may be the colour of the pattern which may also be determined randomly in a palette of predefined colours.

The use of this diversity of parameters makes it possible to increase the randomness of a RAND( ) function applied to a single parameter.

In the embodiment illustrated in FIG. 1 or FIG. 2, the first element 20 of graphic signature is an extract from the first graphic of the first layer 11 of the object, in this instance an extract of guilloche, printed on the object to be made secure/authenticated.

The second graphic element 21 of signature on the second layer may also be a predetermined graphic element (image, logo or other element) or a random graphic element as described above.

For objects such as official documents (identity cards for example), it is conventional that the second layer 12 of the object comprises distinctive or nominative elements of the object, in this instance personal information relating to the bearer of the object, for example the surname, forename, date of birth, etc.

If the object is fitted with an electronic chip, the latter is furnished with a serial number that can be used as a distinctive or nominative element of the object, the chip usually being inserted into another layer (not illustrated) of the object 10.

In one embodiment, the object also comprises a graphic identifier 30, optionally a multilayer identifier, from a photograph of the graphic signature 23; and/or from the said at least one distinctive or nominative element of the object, for example the graphic identifier is generated by an algorithm engine based notably on the personal information and/or on the chip number.

Preferably, the graphic identifier 30 is created during the personalization or the serialization of the object.

For reasons of quality in particular, during the production of the signature by the superposition of the said graphic windows, it is desirable that the relative positional error between the windows F1, F2, F3 be as small as possible, that is to say below a threshold, for example in order to give a uniformity of appearance to all the objects produced.

However, the methods of fabrication and/or of assembly (superposition) of the said windows involve inevitable mechanical tolerances from which a random error of relative position of the said windows results.

Unlike an a priori consisting in seeking to minimize the error, the invention advantageously uses the relative random error of position. Indeed while it is usually sought to minimize process tolerances in order to render mass market products uniform, the invention advantageously uses the error of position that comes from the production process to contribute to product differentiation, namely individualization of the products.

Specifically, since the relative position of the first graphic element 20 (by the first layer 11) and of the second graphic element 21 (by the second layer 12) is random, the signature is therefore unique.

Preferably, in one embodiment, the superposition—in partial or total transparency of a third graphic element on a third layer 13, distinct from the first and second layers, where the relative position of the said third graphic element and of the said first graphic element and/or of the said second graphic element is random—is also provided for the same reasons.

For example, the third graphic element 22 is a hologram supported by a laminate (a laminar layer) and is applied after personalization of the object 10.

Figure 2C:
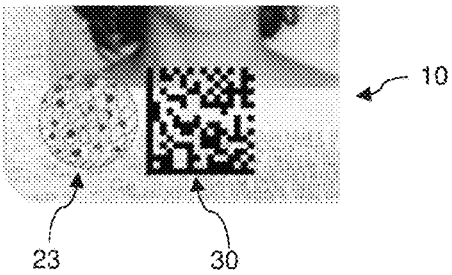
FIG. 2C illustrates in close-up one embodiment of a graphic signature and of a graphic identifier according to the invention.
Figure 2A:
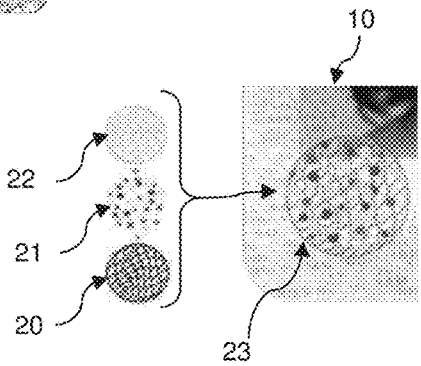
FIG. 2A illustrates an embodiment of a graphic signature according to the invention.

The multi-layer signature 23 therefore comprises, in total or partial superposition, the first 20, the second 21 and optionally third 22 graphic elements (FIG. 2A).

In order to make the object 10 secure, provision is advantageously made to produce, preferably on creation of the object 10 or shortly afterwards, a photograph of the multi-layer graphic signature 23.

This photograph is for example saved in a database. From this photograph, a digital signature is computed and this digital signature is saved in (optionally the same) database, so as to form a portion at least of a reference digital signature. Preferably, two databases are used: one that contains the image of the photograph, and one that contains the computed signature, for reasons of space and security.

The digital signature is computed from the photograph of the graphic signature preferably by a specific algorithm using notably the image processing domain.

In one embodiment, the digital photograph is pre-processed in order to take the noise out of it, rectified based on a preestablished reference point that must of necessity appear on one of the layers in order to correct the possible effects of distortion or of rotation due to the taking of the photograph, then analysed to produce descriptors which will form the said signature, or digital impression.

For example, the descriptors may consist of some or all of the following elements:

- the exact coordinates of certain graphic elements that are expected on the pre-processed image,
- the local or global mathematical moments:
  - of the pre-processed image (described in grey levels or in colour in a particular representation space, for example such as RGB or HSV), or
  - of the image obtained after extraction of its contours, such as the conventional statistical moments (mean, variance, etc.), the Zernike moments, etc.
- other shape descriptors computed on the basis of stable points of the image as described in the scientific literature (SURF—Speeded Up Robust Features, for example)
- other descriptors of colours or of textures computed locally or globally on the pre-processed image, such as colour histograms or descriptors derived from the use of Gabor filters,
- etc.

Once the signature has been computed, a digital identifier is then associated with the said recording of the digital signature so as to make subsequent searches easier by indexation.

The digital identifier may be an index or may correspond to at least one distinctive or nominative element of the object, for example a serial number, the surname and/or forename of the carrier of the object 10, etc.

The digital identifier is stored remotely on the same data server (database) as the reference signature, and preferably accessible in a secure manner, optionally via the Internet.

The digital identifier makes it possible to index the graphic signature. In one embodiment, the digital identifier is a function, for example a hash function, of the digital image of the graphic signature 23.

The graphic identifier 30, for its part, is a software-generated unique graphic code. Typically it corresponds to a unique serial number. Usually it is the number of the document, this number being used to name and index the corresponding signature file a posteriori. It may also carry information relating to the biography of the holder of the object: for example, the lines of the Machine Readable Zone (MRZ) for an identity card or a passport, situated on the back of the object.

It is therefore possible to encode on the front of an object information situated on the back (or another face for objects that are not flat), which means that it is possible not to have to manipulate the object subsequently for verification/authentication phases notably, and therefore makes processing easier and greatly increases the speed of processing of the object.

Figure 2B:
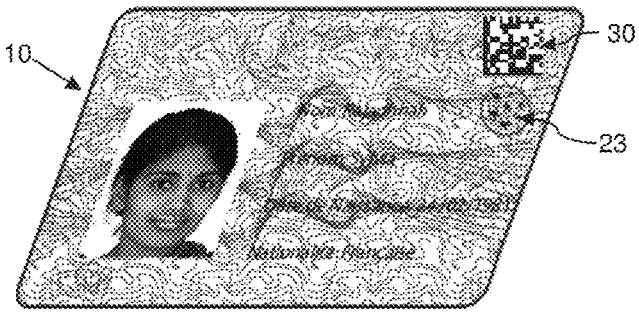
FIG. 2B illustrates an embodiment of an object comprising a graphic signature and a graphic identifier according to the invention.

Preferably, the graphic identifier 30 can be printed and encoded in the form of a two-dimensional bar-code symbol. In this instance, the digital identifier 30 is a data matrix (FIGS. 2B, 2C).

In one embodiment, the graphic identifier 30 is also stored locally on the object, by affixing, printing, bonding, insertion or other method. For example, the Datamatrix is printed on the card 10 after the lamination of at least one of the first 11, second 12 and optionally third 13 layers of the card if the graphic identifier is an index; and after the lamination of all the layers otherwise.

The object 10 is made secure because it is therefore possible to authenticate the said object 10 that is carrying the graphic signature 23 associated therewith.

Accordingly, the verification/authentication of the signature can be carried out in the following manner.

A digital photograph of the multi-layer graphic signature 23 is taken, for example by a camera or any equipment furnished with a CCD sensor and a memory.

The digital photograph of the multi-layer graphic signature 23 is then compared with the reference digital signature.

Preferably, a 1:1 comparison is made between the object 10 to be analysed and the reference digital signature (of the original object or document) bearing one and the same number or one and the same identifier rather than a 1 amongst N search which may be disrupted by the presence of several similar patterns in a database of several million.

The comparison may be made by studying resemblances or by studying differences between a "suspect" signature to be analysed and which is stored on or in a "suspect" object, and an "authentic" reference signature.

In one embodiment, the comparison is made in a manner known per se, notably as an image analysis, by the characterization of shapes (detection of salient points, extraction of contours, etc.), of texture (concurrence matrices, etc.) and of colours, combined. Digitally, it may consist for example in computing a bit error rate (BER) between the two signatures, and in returning "true" when this rate is below a given threshold, "false" in the contrary case. The threshold is chosen preferably so that the statistical probability that the response is erroneous is negligible.

Accordingly, provision is preferably made to extract by optical reading the graphic identifier 30 of the object, for example by taking a digital photograph of the said at least one distinctive or nominative element of the object 10.

It is then sufficient to select from the database the reference signature associated with the extracted identifier and to compare the image of the reference signature and the image of the graphic signature 23 of the object 10.

In another embodiment, the comparison of the graphic signatures is boiled down to the comparison of the digital signatures by an algorithm that is known per se, using notably the image processing domain. Depending on the algorithm chosen for the computation of the digital signature, the comparison may comprise for example the following steps:

- the suspect digital signature is computed exactly as if it were the reference signature,
- the corresponding reference digital signature is found in the database, by virtue of the digital or alphanumerical index deduced from the suspect, the two digital signatures are compared according to one or more predetermined criteria, if all the criteria are validated, the algorithm returns "true", otherwise "false".

The predetermined criteria for the comparison of two digital signatures preferably depend on the nature of the information stored in the latter. For example, a criterion may be based on the computation of a distance between two descriptors that are matched (that is to say computed at the same coordinates or on the same graphic elements of the photograph of the graphic signature of the suspect on the one hand, and of that of the reference on the other hand) according to a formula adapted to the nature of the descriptor. The use of a threshold then makes it possible to accept or reject the criterion depending on whether the distance is below or above the latter.

The decision process is preferably chosen such that the probability of a false response is negligible.

It is also possible to provide in addition, and preferably beforehand, a step of determining the type of signature/object in order to increase the speed of search for the reference signature.

This step comprises the locating of the graphic identifier 30 (DataMatrix, for example) and the determining of its orientation and of its scale in the digital image.

For example, reading the image of the graphic identifier 30 can make it possible to determine that the object is of the identity card type, of the passport type, of the manufactured object type, etc. From this type it is possible to carry out the search for the corresponding reference signature only on the portion of the database in which this type of signature is stored, and not on the whole of the database. It is also possible to provide several databases, one for each type of object, in order to increase the security of the method.

It is possible also to use the coordinates of the graphic identifier 30 and the scale factor that are obtained to extract the image of the graphic signature 23, the location of which is preferably relative to the latter in a predefined manner. The image is then rectified so as to cancel out the possible effects of rotation due to possible manipulations, and standardized at a preestablished standard image resolution that is sufficient for the subsequent analysis steps.

For example, it is possible to provide a "low-level" verification step which consists in ensuring that the image extracted in the previous step has certain characteristics that are common with the type of object. For example, if the graphic signature comprises a print on a constant background having a specific graphic (guilloche, for example), this step may consist in ensuring that the background in question is indeed present on the image, by means of any known image-analysis technique.

If this is not the case, the program can terminate by returning an appropriate message to the user.

The present description is not limited to the embodiments described above.

For example, the object 10 may comprise a packaging, a layer of the said packaging in this instance forming the first layer 11 and/or the second layer 12 of the object 10.

It is therefore possible to provide for the object 10 to comprise a substrate furnished with a background print and optionally an item of personalization information that may comprise random elements.

At the time of packaging the substrate, the position of the packaging relative to the background print, and even to the personalization information, is given with a certain tolerance, hence with a randomness, for the mechanical reasons mentioned above.

On the packaging it is then possible to make arrangement to affix for example a hologram that is at least partially transparent, so as to at least partially overlap the personalization information.

This embodiment is particularly advantageous for making sensitive products secure, for example for pharmaceutical products, for example medications, packaged in a preprinted box, then personalized with a batch number and a date (of fabrication, expiry date, use-by date, etc.); a box on which it is subsequently possible to apply a hologram in the form of a transparent self-adhesive label before carrying out the digital acquisition of the graphic signature at the end of the packaging chain.

The invention claimed is:

1. A method for making an object secure, comprising:

A. a providing step, comprising:

a) providing a first layer, wherein the first layer comprises a first framed area;

the first framed area comprises a set of first graphic elements; and b) providing a second layer, wherein the second layer comprises a second framed area;

the second framed area comprises a set of second graphic elements, said second graphic elements being different from the first graphic elements; wherein the first layer and the second layer have the same shape and the same dimensions;

the shape and the dimensions of said first framed area and of said second framed area are identical to one another; and the position of the first framed area in the first layer is identical to the position of the second framed area in the second layer;

at least part of the first graphic elements is visible through the second framed area when the second framed area overlaps the first framed area;

B) an overlapping step comprising:

overlapping the first layer and the second layer with a machine having mechanical tolerances, leading to a random error of relative position of the first framed area and the second framed area, said random error of relative position being below a threshold;

said random error of relative position creating a unique relative position of the first graphic elements and the second graphic elements;

said method further comprising:

C. a storing step, comprising storing said overlapped first and second layers on or in the object, D) a creating step, comprising creating a graphic identifier, from a photograph of the overlapped assembly of said first framed area and said second framed area; and E) a storing step, comprising storing said graphic identifier on or in the object; wherein the overlapping step comprises overlapping a third framed area, in partial transparency, with the first framed area and the second framed area, said third framed area being disposed on a third layer and comprising a set of third graphic elements;

said third layer being distinct from the first layer and the second layer;

the shapes and dimensions of said first framed area and of said third framed area being identical to one another;

a relative position of the second framed area and of the third framed area being random;

the storing step comprising storing said overlapped first, second and third framed area on or in the object; and the creating step comprising creating a graphic identifier, from a photograph of an overlapped assembly of said first framed area, said second framed area and said third framed area; wherein at least one of the graphic elements from the first set of the first graphic elements, from the second set of the second graphic elements, and from the third set of the third graphic elements is a combination of a predetermined graphic element and a random graphic element wherein at least one of the following characteristics of said graphic element is random and generated by use of an algorithm; wherein said algorithm generates more than a million random graphic elements:

a shape, a pattern, colors, or grey levels, a position in a framed area, and a size.

2. Non-transitory computer-readable medium storing a computer program comprising computer CPU directly executable program-code instructions for the execution of the steps of the method according to claim 1, when said computer program is run on a computer.

3. A multilayered label comprising:

a first layer comprising a first framed area, which comprises a first set of first graphic elements;

a second layer comprising a second framed area, which comprises a second set of second graphic elements;

a third layer comprising a third framed area, which comprises a third set of third graphic elements the shapes and dimensions of said first framed area and of said second framed area and said third framed area being identical to one another; and said first framed area and said second framed area and said third framed area being overlapped in partial transparency with a mechanical random error of relative position, said random error of relative position being below a threshold;

wherein at least one of the first layer and the second layer and the third layer is a packaging layer;

one of the first layer and the second layer and the third layer further comprises a graphic identifier, said graphic identifier being created from a photograph of the overlapped assembly of said first framed area and said second framed area and said third framed area;

wherein a combination of the graphic elements from the first set of the first graphic elements, from the second set of the second graphic elements, from the third set of graphic elements is a predetermined graphic element; and is a random graphic element wherein at least one of the following characteristics of said graphic element is random and generated by use of an algorithm that generates more than a million random graphic elements:

a shape, a pattern, colors, or grey levels, a position in a framed area, and a size.

4. The label according to claim 3, wherein said graphic identifier is printed on one of the layers of said multi-layer label in the form of a data matrix.

5. The label according to claim 3, further comprising a self-adhesive layer.

* * * * *